US008770825B2

(12) United States Patent
Takemoto et al.

(10) Patent No.: US 8,770,825 B2
(45) Date of Patent: Jul. 8, 2014

(54) KNEADING APPARATUS WITH ROTARY SHAFTS HAVING STIRRING MEMBERS

(75) Inventors: Yusuke Takemoto, Machida (JP); Keiichi Takahashi, Yokohama (JP); Takahiro Shibuya, Fujisawa (JP)

(73) Assignee: Shin Nichinan Co., Ltd. (JP)

( * ) Notice: Subject to any disclaimer, the term of this patent is extended or adjusted under 35 U.S.C. 154(b) by 1098 days.

(21) Appl. No.: 12/733,980

(22) PCT Filed: Sep. 10, 2008

(86) PCT No.: PCT/JP2008/066282

§ 371 (c)(1),
(2), (4) Date: Jul. 15, 2010

(87) PCT Pub. No.: WO2009/044608

PCT Pub. Date: Apr. 9, 2009

(65) Prior Publication Data

US 2010/0284237 A1 Nov. 11, 2010

(30) Foreign Application Priority Data

Oct. 2, 2007 (JP) ..... 2007-258231

(51) Int. Cl.
*B01F 7/04* (2006.01)

(52) U.S. Cl.
USPC ..... 366/97; 366/298; 366/300; 366/301; 366/325.3; 366/326.1; 366/327.1; 366/328.2

(58) Field of Classification Search
USPC ..... 366/96–99, 297–301, 171.1, 366, 320, 366/322, 307, 325.1, 325.3, 326.1, 366/327.1–327.3, 328.2, 266; 416/197 R; 422/229
See application file for complete search history.

(56) References Cited

U.S. PATENT DOCUMENTS

| | | | | | |
|---|---|---|---|---|---|
| 2,029,688 | A | * | 2/1936 | Wilson | 208/339 |
| 4,155,657 | A | * | 5/1979 | King et al. | 366/172.1 |
| 4,278,355 | A | * | 7/1981 | Forberg | 366/300 |
| 4,281,934 | A | * | 8/1981 | Krause et al. | 366/30 |
| 4,364,667 | A | * | 12/1982 | Reiner | 366/325.3 |
| 4,438,634 | A | * | 3/1984 | Merle et al. | 62/123 |
| 4,838,704 | A | * | 6/1989 | Carver | 366/307 |
| 5,151,288 | A | * | 9/1992 | Curry et al. | 426/474 |

(Continued)

FOREIGN PATENT DOCUMENTS

| | | | | | |
|---|---|---|---|---|---|
| JP | 55011459 | A | * | 1/1980 | B65G 53/46 |
| JP | 62157113 | A | * | 7/1987 | B65G 33/24 |

(Continued)

*Primary Examiner* — Charles E Cooley
(74) *Attorney, Agent, or Firm* — Adams & Wilks

(57) ABSTRACT

A kneading apparatus has a pair of rotary shafts mounted to undergo rotation in different directions of rotation and at different rotational speeds from one another. Stirring members are helically arranged on outer peripheries of the rotary shafts at predetermined helical and angular pitches for kneading an object during rotation of the rotary shafts. The helical pitch of the stirring members of one of the rotary shafts has an inverse helix from that of the stirring members of the other rotary shaft. The stirring members have surfaces with a first phase configured to move the kneaded object in a feed direction or a second phase symmetrical to the first phase and configured to move the kneaded object in a direction reverse to the feed direction. The stirring members are arranged so that the first and second phases cyclically repeat in a predetermined sequence in axial directions of the rotary shafts.

16 Claims, 11 Drawing Sheets

(56) References Cited

U.S. PATENT DOCUMENTS

| | | | | | |
|---|---|---|---|---|---|
| 5,403,087 | A | * | 4/1995 | Irie et al. | 366/66 |
| 5,460,448 | A | * | 10/1995 | Woolsey | 366/301 |
| 2003/0161215 | A1 | * | 8/2003 | Hinken et al. | 366/300 |
| 2010/0284237 | A1 | * | 11/2010 | Takemoto et al. | 366/85 |

FOREIGN PATENT DOCUMENTS

| | | | | | |
|---|---|---|---|---|---|
| JP | 63-151341 | | * | 6/1988 | |
| JP | 11-104477 | | * | 4/1999 | |
| JP | 11221818 | A | * | 8/1999 | B28C 5/14 |
| JP | 11221819 | A | * | 8/1999 | B28C 5/14 |
| JP | 2000-204164 | | * | 7/2000 | |
| JP | 2000226864 | A | * | 8/2000 | E02F 7/00 |
| JP | 2000-317289 | | * | 11/2000 | |
| JP | 2000342949 | A | * | 12/2000 | B01F 7/04 |
| JP | 2001-140208 | | * | 5/2001 | |
| JP | 2001300483 | A | * | 10/2001 | B09B 3/00 |
| JP | 2001300484 | A | * | 10/2001 | B09B 3/00 |
| JP | 2002070064 | A | * | 3/2002 | E02F 7/00 |
| JP | 2003019425 | A | * | 1/2003 | B01F 7/04 |
| JP | 2004-113878 | | * | 4/2004 | |
| JP | 2004-315259 | | * | 11/2004 | |
| JP | 2004-344710 | | * | 12/2004 | |
| JP | 2005-246214 | | * | 9/2005 | |
| JP | 2005313097 | A | * | 11/2005 | B01F 7/04 |
| JP | 2006-75807 | | * | 3/2006 | |
| JP | 2006239554 | A | * | 9/2006 | |
| JP | 2007196178 | A | * | 8/2007 | |
| JP | 2012250236 | A | * | 12/2012 | |
| SU | 550285 | | * | 3/1977 | |
| WO | 2009/044608 | A1 | * | 4/2009 | |

* cited by examiner

KNEADING APPARATUS WITH ROTARY SHAFTS HAVING STIRRING MEMBERS

CROSS-REFERENCE TO RELATED APPLICATIONS

This application is a U.S. national stage application of International Application No. PCT/JP2008/066282 filed Sep. 10, 2008, claiming a priority date of Oct. 2, 2007, and published in a non-English language.

BACKGROUND OF THE INVENTION

Technical Field

The present invention relates to a kneading apparatus for kneading an object to be kneaded, and more specifically to a kneading apparatus in which two rotary shafts each having a plurality of paddles as stirring members provided on the external periphery thereof are disposed parallel to each other and caused to rotate in opposite directions to knead an object to be kneaded with the paddles.

BACKGROUND ART

Conventionally, such a kneading apparatus (mixer) has been used, for example, in mixing dehydrated sludge, incinerated or collected dust, cement and other types of dust mixed with a solidifier, or fertilizer and other types of powdery or granular material, and also in kneading powdery or granular material with liquids added thereto.

This type of kneading apparatus is disclosed in Patent Document 1, in which a plurality of paddles is erected and arranged spirally. First and second rotary shafts are caused to rotate in opposite directions to convey an object to be kneaded in a direction along the two rotary shafts while being stirred and kneaded by the paddles. The two rotary shafts are rotated such that the distal ends of the paddles come in proximity to the external peripheral surface of the facing rotary shaft. Causing the two rotary shafts to rotate at unequal speeds causes the paddles of the two rotary shafts to scrape off the kneaded object that has adhered to the external peripheral surface of the other rotary shaft, thus performing self-cleaning. The paddles of the two rotary shafts are all attached at a specified incline of about 45°, for example, relative to the center axes of the rotary shafts so that the kneaded object is pushed in the conveying direction in accordance with the rotation of the rotary shafts during kneading.

Patent Document 1: Japanese Laid-open Patent Application No. 1987-157113

However, the configuration of the conventional kneading apparatus has the following problems.

Although not a problem in the case of mixing powdery or granular materials, "lumping" sometimes occurs in cases of kneading a powdery or granular material with a liquid. The liquid aggregates and forms clumps in part of the powdery or granular material depending on the blend ratio or at times such as when the liquid is highly viscous. When lumping occurs, it is not easily resolved, and in some cases uniform kneading of the entire material will be impeded.

In an arrangement in which self-cleaning is performed, as is described in Patent Document 1, the facing paddles of the two rotary shafts repeatedly move toward and away from each other with every rotation of the rotary shafts. When the facing paddles are nearest to each other, the kneaded object can be squeezed therebetween and the lumps in the kneaded object can be crushed to a certain extent.

However, this action of crushing lumps has not proved sufficient. Specifically, when the facing paddles of the two rotary shafts are nearest to each other, the object kneaded therebetween receives a pressing force, which causes the kneaded object between the paddles to escapes in the conveying direction along the incline of the paddles, depending on the nature of the material, thereby reducing the lump-crushing effect by half. In this case, sufficiently uniform kneading is no longer possible.

In the case of a batch-type kneading apparatus in which the materials to be kneaded are supplied all at once, kneaded, and discharged all at once, it is somewhat possible to adjust the degree of kneading by adjusting the operation time. In the case of a continuous-type kneading apparatus in which the materials to be kneaded are mixed while being sequentially and continuously supplied and then continuously discharged, there are limits to adjust the degree of kneading because the amount of the material supplied per unit time determines the time for which the kneaded object should remain in the apparatus (stirring time of the kneaded object). Therefore, it has been difficult to adjust the degree of kneading and perform kneading efficiently depending upon the application of the kneading apparatus.

Furthermore, a continuous-type kneading apparatus has the advantages of being small in size and capable of handling large amounts. However, in cases in which the material to be kneaded is highly fluid or cases in which the amount of the material to be kneaded is greater than the handling capacity of the apparatus, the so-called short pass phenomenon sometimes occurs in which the supplied material to be kneaded passes through the apparatus without being kneaded. This results in entirely insufficient kneading.

An object the present invention, which was devised in order to overcome such problems, is to provide a small-sized kneading apparatus being capable of efficiently performing sufficient and uniform kneading.

SUMMARY OF THE INVENTION

According to the present invention, there is provided a kneading apparatus in which a first rotary shaft having a plurality of paddles as stirring members provided on the external periphery thereof so as to be arranged helically at a predetermined helical pitch and at intervals of a predetermined angular pitch, and a second rotary shaft having a plurality of paddles as stirring members provided on the external periphery thereof so as to be arranged helically with the inverse helix from the first rotary shaft at a predetermined helical pitch and at intervals of a predetermined angular pitch are disposed in parallel and rotated in opposite directions at unequal speeds to each other to knead an object with the paddles, the helical pitch ratio of the first and second rotary shafts being the inverse of the rotational speed ratio of the first and second rotary shafts, and the angular pitch ratio of the paddles of the first and second rotary shafts being the same as the rotational speed ratio of the first and second rotary shafts, wherein the paddles of the first and second rotary shafts are arranged so that the paddle surfaces assume either a normal phase to advance the kneaded object in a feed direction, or a reverse phase symmetrical to the normal phase relative to a center axis of the rotary shaft, and the paddles of the rotary shafts that are positioned equidistant from the ends thereof as viewed in the axial direction of the rotary shafts face to each other with the surfaces thereof assuming the same phase; and the paddles of the first and second rotary shafts are arranged so that the normal phases and reverse phases cyclically repeat in a predetermined sequence as seen in the axial direction of the rotary shafts.

According to the present invention, the kneaded object in the conveying direction stays during kneading in multiple locations where the paddles helically arranged on the external peripheries of the two rotary shafts are adjacent in the sequence of normal phase and reverse phase. This prevents the kneaded object from escaping from between paddles coming in closest possible proximity during lump-crushing action, thereby increasing the lump-crushing effect. Additionally, the time of the material to be kneaded staying from supply to discharge is made greater, allowing the stirring action including the lump-crushing action to be sufficiently performed multiple times and allowing the lumps to be dissolved and sufficient and uniform kneading to be performed. Even with a small-sized continuous-type apparatus, the staying time of the kneaded object can be increased, and sufficient and uniform kneading can be performed.

According to the present invention, since the paddles are attached to the rotary shafts so, that the angles of the paddle surfaces relative to the direction along the helices can be adjusted, the kneading degree can be adjusted according to the application of the kneading apparatus and more efficient kneading is made possible.

KEY TO SYMBOLS

1 Housing
1*a* Supply opening
1*b* Discharge opening
2 Frame
3, 4 Rotary shafts
7, 8 Rods
9, 10 Bearings
11 Gear box
12, 13 Gears
14, 16 Sprockets
15 Chain
17 Motor
Pn, Pn', Qn, Qn' Paddles

DETAILED DESCRIPTION OF THE PREFEERED EMBODIMENTS

The present invention will now be described with reference to preferred embodiments shown in the attached drawings. The kneading apparatus will be described via embodiments in which a powdery or granular material is kneaded with a liquid, but the kneading apparatus can also be applied to cases of mixing only a powdery or granular material or cases of mixing a powdery or granular material with an extremely small amount of liquid added thereto.

Embodiment 1

Figure 1:
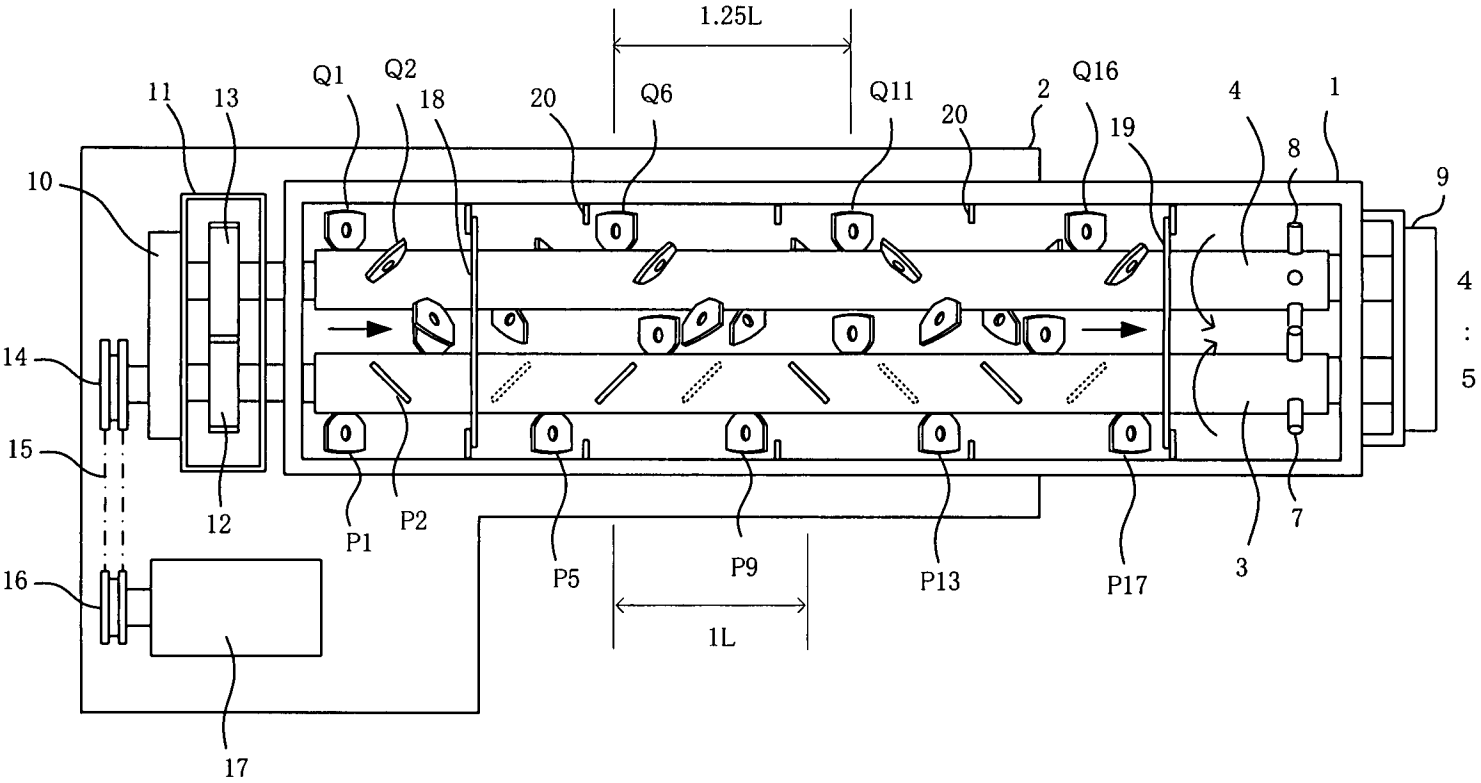
FIG. 1 is a top view showing a kneading apparatus in which paddles are arranged in a single helix with a large part of the top of the housing removed therefrom (Embodiment 1)
Figure 2:
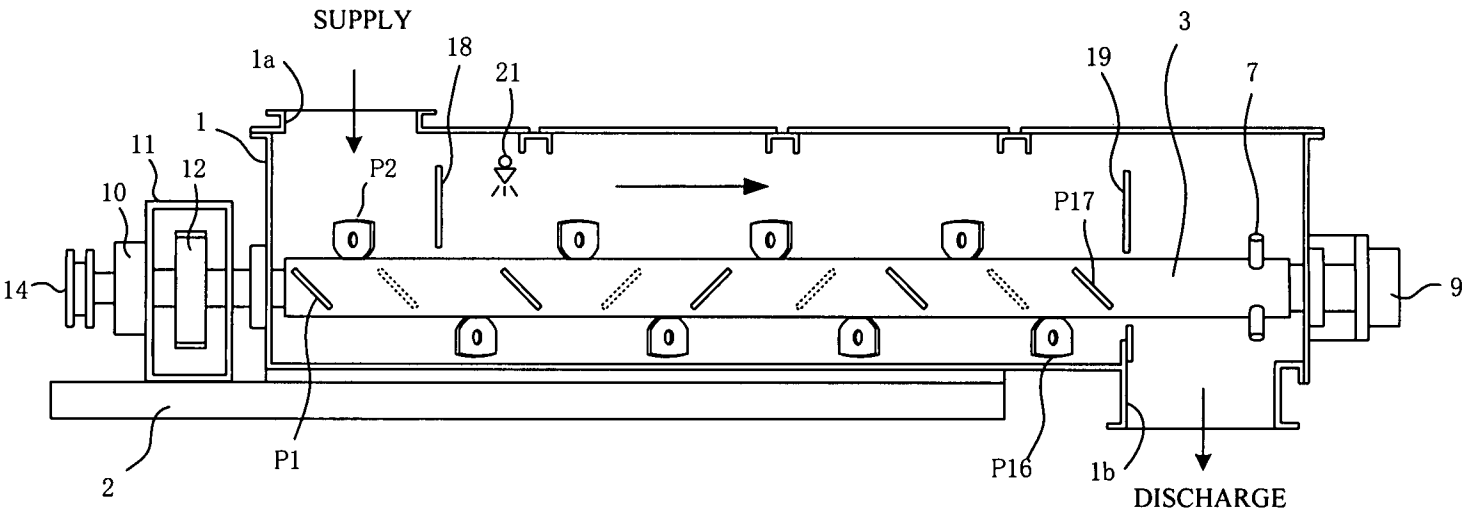
FIG. 2 is a side view along one rotary shaft inside the housing of the kneading apparatus.
Figure 3A:
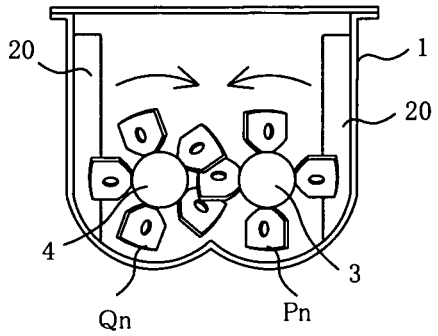
FIG. 3*a* is a cross-sectional view orthogonal to the rotary shafts, showing the paddles of the rotary shafts that are provided in the kneading apparatus.
Figure 3B:
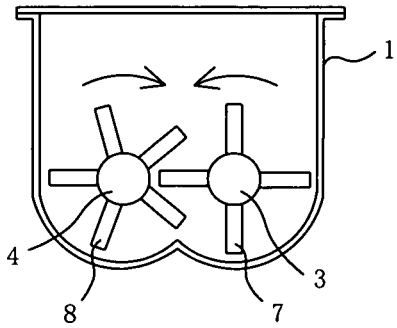
FIG. 3*b* is a cross-sectional view showing the rods of the rotary shafts that are provided in the kneading apparatus.
Figure 4:
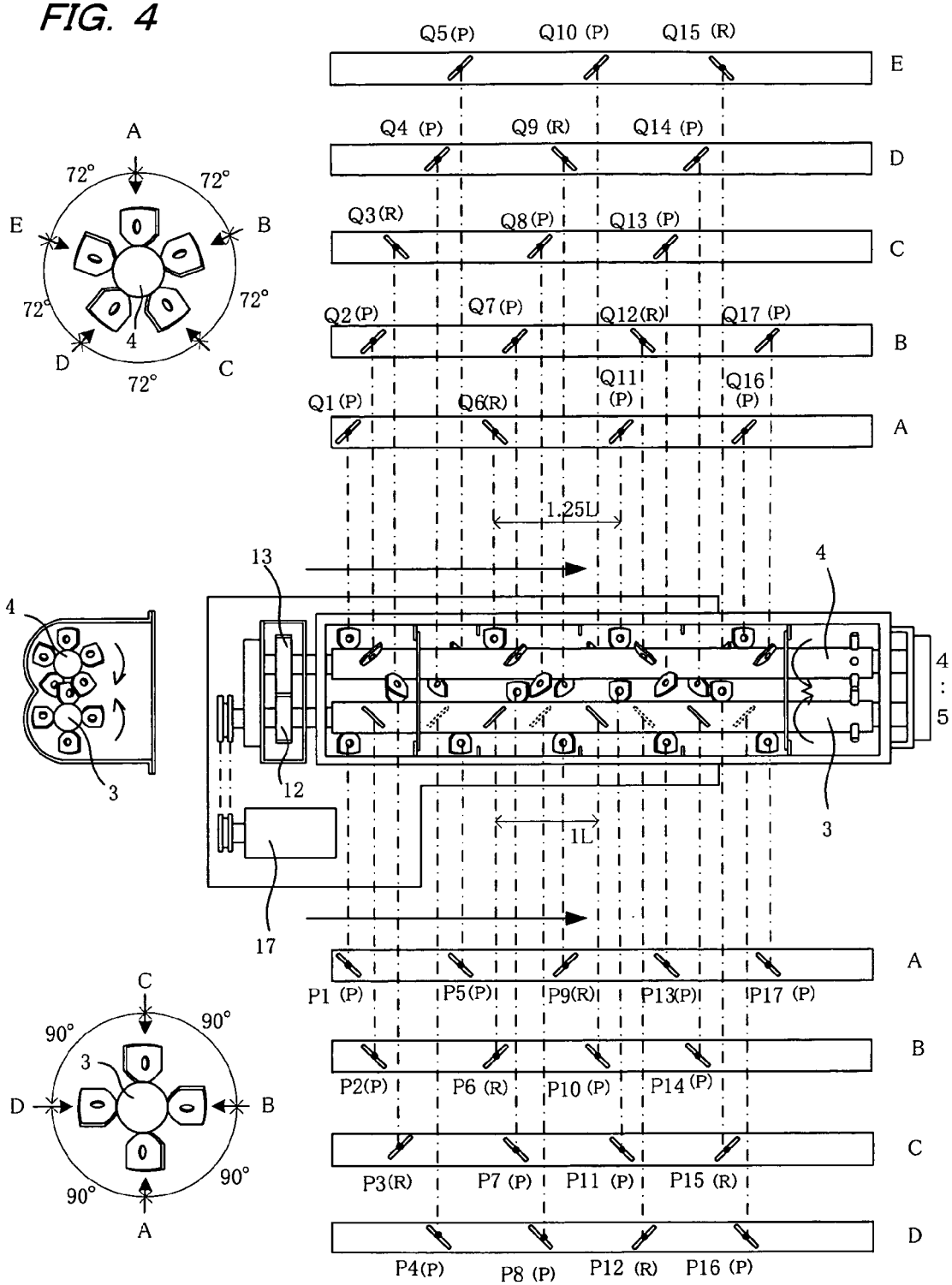
FIG. 4 is an illustrative expanded view showing the paddle arrangements on the rotary shafts in Embodiment 1.

FIGS. 1 through 4 show the structure of a kneading apparatus according to Embodiment 1 of the present invention. FIG. 1 is a top view showing the kneading apparatus with a large part of the top of the housing removed therefrom, FIG. 2 is a side view along one rotary shaft in the housing of the kneading apparatus, FIGS. 3*a* and 3*b* are cross-sectional views orthogonal to the rotary shafts, showing the paddles and rods of the rotary shafts provided in the kneading apparatus, and FIG. 4 is an illustrative view showing the arrangement of paddles when the rotary shafts are viewed from the directions A to D (A to E).

In FIGS. 1 through 4, reference numeral 1 indicates a housing of the kneading apparatus, which is provided horizontally on a base frame 2. The housing 1 is formed into a long, thin, rectangular parallelepiped shape. At the top of the left end shown in FIG. 2, a supply opening 1*a* is provided for supplying (dropping in) material (powdery or granular material) to be kneaded from a hopper (not shown) into the housing 1. At the bottom of the right end, a discharge opening 1*b* is provided for discharging (dropping out) from the housing 1 onto a conveyor belt (not shown) the object that is supplied and kneaded with the added liquid. While being kneaded, the kneaded object is conveyed to the right away from the supply opening 1*a* toward the discharge opening 1*b* as shown by the arrows.

Inside the housing 1, two rotary shafts 3, 4 of the same diameter are provided in parallel to each other in the longitudinal direction. The rotary shafts are rotatably supported by a bearing 9 provided on the external side at the right end of the housing 1 in FIG. 1, and a bearing 10 provided on the frame 2 in proximity to the external side at the left end of the housing 1.

Gears 12, 13 are fixed to the portions of the rotary shafts 3, 4 that are inserted through a gear box 11 at the left end of FIG. 1 so as to mesh with each other.

Furthermore, the left end of the rotary shaft 3 in FIG. 1 protrudes to the outside from the bearing 10, and a sprocket 14 is fixed to the left end thereof. A motor 17 is provided on the frame 2, and a sprocket 16 is fixed to the output shaft thereof. A chain 15 is stretched between the sprockets 16 and 14.

A unidirectional rotational drive force from the motor 17 is transmitted to the rotary shaft 3 via the chain 15 and the sprocket 14, causing the rotary shaft 3 to rotate in one direction, and the rotational drive force is also transmitted to the rotary shaft 4 via the gears 12, 13, causing the rotary shaft 4 to rotate in the opposite direction. The rotary shafts 3, 4 are caused to rotate via the gears 12, 13 at an unequal rate with a rotational speed ratio of N:N−1, e.g., 5:4. The rotating directions of the rotary shafts 3, 4 during kneading are such that the shafts rotate inward towards each other when viewed from above, as seen in FIGS. 1, 3*a*, and 3*b*.

Paddles P1 to P17 and Q1 to Q17, serving as stirring members, are provided on the external peripheries of the rotary shafts 3, 4. In FIGS. 1 and 3*a*, only some of the paddles are shown by symbols in order to keep the drawings from becoming too complex. The paddles P1 to P17 and Q1 to Q17 are all flat plates having the same rectangular shape with through-holes (shown as substantial circles in the drawings) formed in the center thereof. The height of each of the paddles P1 to P17 and Q1 to Q17 (the amount by which they protrude from the external peripheries of the rotary shafts 3, 4) is slightly less than the distance between the external peripheries of the rotary shafts 3, 4. The distal ends of the paddles come near to the external periphery of the other rotary shaft as the rotary shafts rotate, and scrape off any of the kneaded object that has adhered to the rotary shafts. This makes self-cleaning of the rotary shafts possible.

The paddles P1 to P17 are arranged helically at a predetermined helical pitch on the external periphery of the rotary shaft 3 with an offset at predetermined angular pitches in the rotational direction of the rotary shaft 3, while the paddles Q1 to Q17 are arranged helically, with the inverse helix from the paddles P1 to P17, at a predetermined helical pitch on the external periphery of the rotary shaft 4 with an offset at predetermined angular pitches in the rotational direction of the rotary shaft 4. The helical pitch ratio of the paddles P1 to P17 and the paddles Q1 to Q17 is set so as to be the inverse of the rotational speed ratio of the rotary shafts 3 and 4, e.g., when the rotational speed ratio of the rotary shafts 3 and 4 is 5:4 as described above, the ratio of the pitches is inverse, such as 1 L:1.25 L. The angular pitch ratio of the paddles P1 to P17 and the paddles Q1 to Q17 is set so as to be the same as the rotational speed ratio of the rotary shafts 3 and 4, e.g., when the rotational speed ratio of the rotary shafts 3 and 4 is 5:4 as described above, the ratio of angular pitches is the same as the rotational speed ratio of the rotary shafts 3 and 4, i.e., the angular pitch of the paddles P1 to P17 is 90°, and angular pitch of the paddles Q1 to Q17 is 72°.

The paddles P1 to P17 and Q1 to Q17 are arranged so that the paddle surfaces are in a normal phase on the helix (feed helix) to advance the kneaded object in the feed direction, or the paddle surfaces are in a reverse phase symmetrical to the normal phase relative to the rotational center axes of the rotary shafts. In addition, the paddles are arranged so that the surfaces of the paddles that are in facing positions on the rotary shafts 3, 4 have the same phase. The paddles P1 to P17 and Q1 to Q17 are also arranged so that the normal phases and reverse phases cyclically repeat in a predetermined sequence in the axial directions of the rotary shafts.

FIG. 4 is an expanded view of this arrangement of paddles, wherein a view similar to FIG. 1 is shown in the center. The arrangement of paddles on the rotary shaft 4 when viewed from the directions A to E, which are different from each other by 72°, is shown at the top, and the arrangement of paddles on the rotary shaft 3 when viewed from the directions A to D, which are different from each other by 90°, is shown at the bottom.

As can be seen from FIG. 4, the paddles Pn and the paddles Qn (n=1 to 17) having the same number n are placed the same distance from the ends of the rotary shafts 3, 4 as seen from the axial direction. As the number n increases in increments of 1, the paddles Pn and Qn are attached to a position where they are a predetermined distance away to the right in the axial direction as shown by the arrows (the position shown by the next single-dotted line) and where the rotary shafts rotate by a predetermined rotational angle (angular pitch). Therefore, given that the paddles P1 and Q1 are attached at positions equidistant from the ends of the rotary shafts 3, 4 and facing in opposite directions as shown by the single-dotted lines, the paddle P2 is attached at the position that is shown by the next single-dotted line to the right and that is offset inward at a 90° angular pitch, and the paddle Q2 is attached to the single-dotted line position that is the same as the single-dotted line where the paddle P2 is placed and that is offset inward at a 72° angular pitch. Similarly, as the number n increases in increments of 1, the paddles Pn and Qn (n=3 to 17) are attached to the positions shown by the next single-dotted lines that are a predetermined distance away in the axial direction and are offset inward at angular pitches of 90° and 72°, respectively. With this arrangement, the paddles P1 to P17 are arranged helically on the rotary shaft 3, while the paddles Q1 to Q17 are arranged on the rotary shaft 4 helically with the inverse helix from the helix of the paddles P1 to P17 with the helical pitch ratio of 1 L:1.25 L, which is the inverse of the rotational speed ratio 5:4 of the rotary shafts 3, 4. The paddles Pn, Qn (n=1 to 17) are also arranged so that surfaces of paddles of the same number n have the same phase, and the normal phases and reverse phases in the axial direction of the rotary shafts 3, 4 have a predetermined sequence; i.e., the phase sequence "normal, normal, reverse" cyclically repeats so that the phases are "normal, normal, reverse, normal, normal, reverse, normal, normal, reverse, etc." as shown in FIG. 4. In FIG. 4, (P) indicates a paddle having a normal phase, and (R) indicates a paddle having a reverse phase.

The kneading apparatus 1 is also provided with blocking plates 18, 19 for blocking the kneaded object up to a predetermined height, and a plurality of side blocking plates 20 is provided between these blocking plates. The side blocking plates 20 are provided at a plurality of locations in the area between the blocking plates 18 and 19 inside the housing 1 so as to protrude on the sides of the rotary shafts 3, 4 a predetermined amount inside from the left and right surfaces of the housing 1. The side blocking plates 20 partially block the kneaded object on the sides of the rotary shafts 3, 4.

At the ends of the rotary shafts 3, 4 above the discharge opening 1*b*, a plurality of rods 7, 8 is provided at predetermined angular intervals on the peripheries of the rotary shafts 3, 4. The ratio of these angles is the same as the rotational speed ratio of N:N−1, e.g., 5:4. For example, four rods 7 are provided at 90° intervals, and five rods 8 are provided at 72° intervals. The rods 7, 8 serve to self-clean the ends of the rotary shafts 3, 4 on the side of the discharge opening 1*b*.

Inside the housing 1 in proximity to the blocking plate 18 on the far side in the kneaded object conveying direction, a feed pipe (nozzle) 21 is provided for pouring into the housing 1 a liquid that is added to the material to be kneaded.

Next, the kneading action of the kneading apparatus of the present embodiment will be described.

During kneading, the motor 17 is driven to rotate the rotary shafts 3, 4 inward at unequal speeds in opposite directions at a rotational speed ratio of 5:4 as shown in FIGS. 1 and 3*a*. The material to be kneaded (powdery or granular material) is supplied into the housing 1 through the supply opening 1*a*.

The helix of the rotary shaft 3 has a helical shape for feeding and conveying the kneaded object to the right in FIG. 1 when the rotary shaft 3 rotates in the illustrated direction, thereby constituting a feeding helix. The helix of the rotary shaft 4 is an inverse of the helix of the rotary shaft 3, and the helix of the rotary shaft 4 is likewise a feeding helix because the rotary shaft 4 rotates in the opposite direction of the rotary shaft 3. Therefore, the normal phase paddles on the feeding helices push the kneaded object to the right, and the reverse phase paddles push the kneaded object back in the other direction.

In this embodiment, since the paddles Pn and Qn are arranged in a cyclically repeating phase sequence of "normal, normal, reverse," the kneaded object undergoes the actions "feed, feed, return;" and since the normal phase paddles are altogether more numerous than the reverse phase paddles, the kneaded object is conveyed to the right toward the discharge opening 1*b* while being stirred by the paddles. Since the ratio of the helical pitches of the rotary shafts 3, 4 is the inverse of the rotational speed ratio of the rotary shafts 3, 4, the conveying speeds by the rotary shafts 3, 4 in the axial direction are in theory the same.

Since the angular pitch ratio of the paddles Pn and Qn is the same as the rotational speed ratio of the rotary shafts 3, 4, paddles Pn and Qn in the same position as viewed in the axial direction (paddles of the same number n) do not collide with each other when the rotary shafts 3, 4 rotate. Since the distal ends of the paddles come in proximity to the external periphery of the facing rotary shaft in accordance with the rotation of the rotary shafts 3, 4, the kneaded object adhering to the external peripheral surface of the facing rotary shaft is scraped off, and the rotary shafts are self-cleaned. Furthermore, two facing paddles repeatedly move toward and away from each other at predetermined rotational speed cycles, and the kneaded object is ground up between the paddles.

The kneaded object is caught and pressed between the two paddles when a pair of two facing paddles Pn, Qn is most close together. This allows the lumps to be crushed in cases where they are formed in the kneaded object. The kneaded object between the paddles acts against the pressing force and attempts to escape either in the conveying direction of the kneaded object or in the opposite direction along the incline of the paddles, depending on the nature of the material. The arrangement sequence of repeating phases "normal, normal, reverse" of the paddles Pn, Qn causes the kneaded object to stagnate in the conveying direction in multiple locations where normal phase paddles and reverse phase paddles are adjacent. This hinders the kneaded object caught and pressed between paddles from escaping in the conveying direction or in the opposite direction, thereby increasing the effect of crushing the lumps. Since the flow in the conveying direction stagnates, the staying time from the supply of the object to be kneaded until the discharge thereof becomes longer, and the stirring action including the lump-crushing action can be sufficiently performed multiple times, allowing the lumps to be eliminated and sufficient and uniform kneading to be performed. Even with a small-sized continuous-type apparatus, the time duration for which the kneaded object stays can be increased, and sufficient and uniform kneading can be performed.

The greater the number of normal phase paddles, the greater the conveying force for conveying the kneaded object, as well as the shorter the staying time from the supply of the object to be kneaded to the discharge thereof, and the lower the kneading degree of the object. Also, the greater the number of reverse phase paddles, the greater the returning force that attempts to return the kneaded object in the direction opposite the conveying direction, as well as the longer the staying time of the kneaded object and the higher the kneading degree of the object.

Since through-holes are formed in the centers of the paddles Pn, Qn, it is possible to reduce the reaction force acting on the rotary shafts 3, 4 when the kneaded object is caught and pressed between the paddles. Furthermore, when the kneaded object between the paddles passes through the through-holes, a shearing force acts thereon and the kneading can be accelerated.

If the side blocking plates 20 are not provided, the kneaded object moving in the conveying direction along the rotary shafts during kneading passes unhindered along the external sides of the rotary shafts 3, 4 between the blocking plates 18, 19 in the housing 1. Therefore, this object is not stirred as well or kneaded as well as compared with the kneaded object moving between the rotary shafts 3, 4. However, since the side blocking plates 20 are provided, the kneaded object moving over the external sides is hindered by the side blocking plates 20 and guided so as to move to the internal sides, i.e. between the rotary shafts 3, 4, assuring well kneading this object. In other words, the staying time of the kneaded object altogether can be increased, and the kneading degree can be increased.

In cases in which the material to be kneaded is highly jetting, the material to be kneaded is hindered in multiple locations by the side blocking plates 20 from directly flowing in the conveying direction over the external sides of the rotary shafts 3, 4 along the rotary shafts 3, 4. The material to be kneaded is caused to move inward and is then kneaded. Therefore, the occurrence of short passes can be prevented, and kneading can be performed sufficiently.

Figure 5:
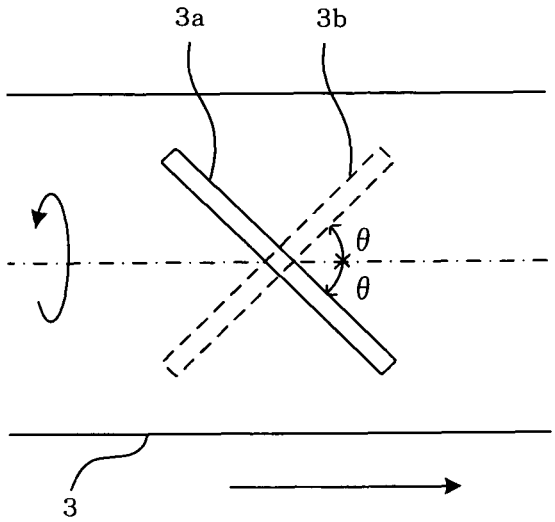
FIG. 5 is an illustrative view showing the inclination of a normal phase paddle and a reverse phase paddle relative to the center line of the rotary shaft.

The conveying force or the returning force during kneading can be varied by adjusting the direction along which the paddles Pn (Qn) are attached. For example, it is possible to adjust the inclination θ of the paddle surface of a normal phase paddle 3*a* or a reverse phase paddle 3*b* relative to the rotational center axis. The conveying force or returning force during kneading can be maximized by adjusting the paddle surfaces in the direction of the helix or in a direction orthogonal thereto, and the conveying force or returning force can be reduced by offsetting the paddle surfaces from the direction of the helix or the direction orthogonal thereto. The arrow in FIG. 5 indicates the conveying direction of the kneaded object, while the single-dotted line indicates the rotational center axis.

Figure 6:
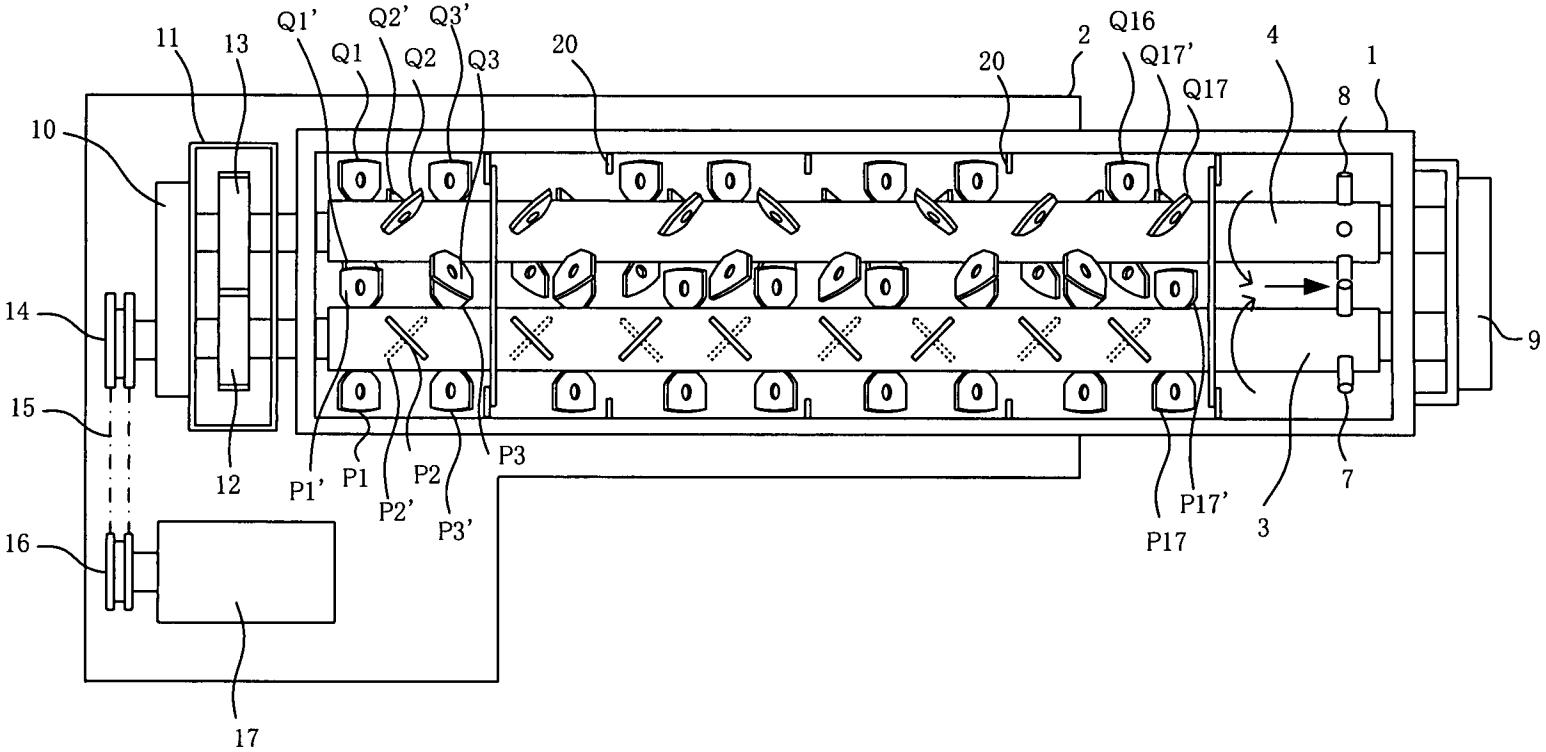
FIG. 6 is a top view showing a kneading apparatus in which paddles are arranged in two helices with a large part of the top of the housing removed therefrom (Embodiment 2)
Figure 7:
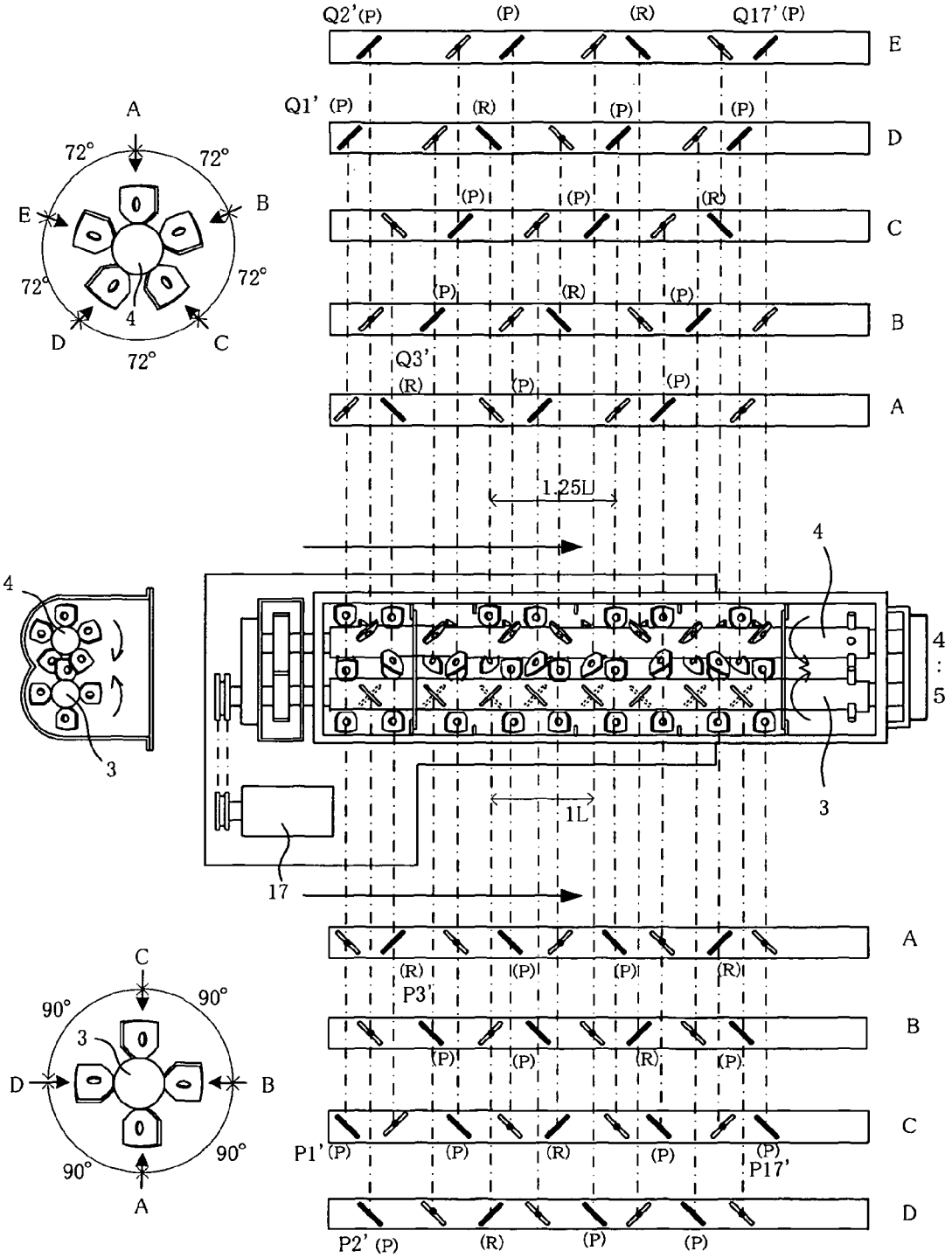
FIG. 7 is an illustrative expanded view showing the paddle arrangements on the rotary shafts in Embodiment 2.

FIGS. 6 and 7 show another embodiment of the present invention, wherein paddles Pn' (n=1 to 17) having the same phase as the paddles Pn (n=1 to 17) are arranged on the rotary shaft 3 at locations that are the same distance away from the end of the shaft as the paddles Pn as viewed in the axial direction and that are offset angularly in the rotating direction of the rotary shaft 3 by an angle that is N times the angular pitch of the paddles Pn (e.g. if N=2 then 90°×2=180°). As shown in FIGS. 6 and 7, paddles P1 and P1', P2 and P2', P17 and P17', etc., which are in the same positions in the axial direction as viewed from the shaft end, are all arranged in a normal phase while being offset by 180°, and the paddles P3, P3' in the same position in the axial direction are arranged in a reverse phase while being offset by 180°.

With this type of arrangement, if the helix formed by the arrangement of the paddles Pn is a first helix, another helix is formed by the arrangement of the paddles Pn', and this second helix formed has a phase offset by a predetermined angle (180°) in the rotational direction of the rotary shaft 3 and has the same helical pitch and helical direction.

Similarly, paddles Qn' (n=1 to 17) having the same phase as the paddles Qn (n=1 to 17) arranged on the rotary shaft 4 are located the same distance from the end of the shaft as the paddles Qn along the axial direction, while being provided in angular positions offset in the same direction that the rotary shaft 4 rotates, the offset being an angle that is N times the angular pitch of the paddles Qn (e.g. if N=2 then 72°×2=144°). In the illustrated embodiment, paddles Q1 and Q1', Q2 and Q2', Q17 and Q17', etc., which are in the same positions in the axial direction, are all arranged in a normal phase while being offset by 144°, while paddles Q3, Q3' in the same position in the axial direction are arranged in a reverse phase while being offset by 144°.

With this type of arrangement, one helix is formed by the arrangement of the paddles Qn and the other helix is formed by the arrangement of the paddles Qn', wherein the two helices have a phase different by a predetermined angle) (144°) in the rotational direction of the rotary shaft 4 and have the same helical pitch and helical direction.

In order to avoid complexity in FIG. 7, the paddles Pn, Qn shown in FIG. 4 are herein shown in white, the paddles Pn', Qn' arranged along the other helix are shown in black, normal phase paddle surfaces are shown as (P), and reverse phase paddle surfaces are shown as (R).

According to the present embodiment, kneading and conveying of the kneaded object by the additional paddles Pn', Qn' are the same as kneading and conveying of the kneaded object by the paddles Pn, Qn. Therefore, the frequency of the lump-crushing action can be increased by twice or more and the lump-crushing effect can also be increased. The frequency of stirring by the paddles is thus increased, and kneading degree is increased with more uniform kneading.

Figure 8:
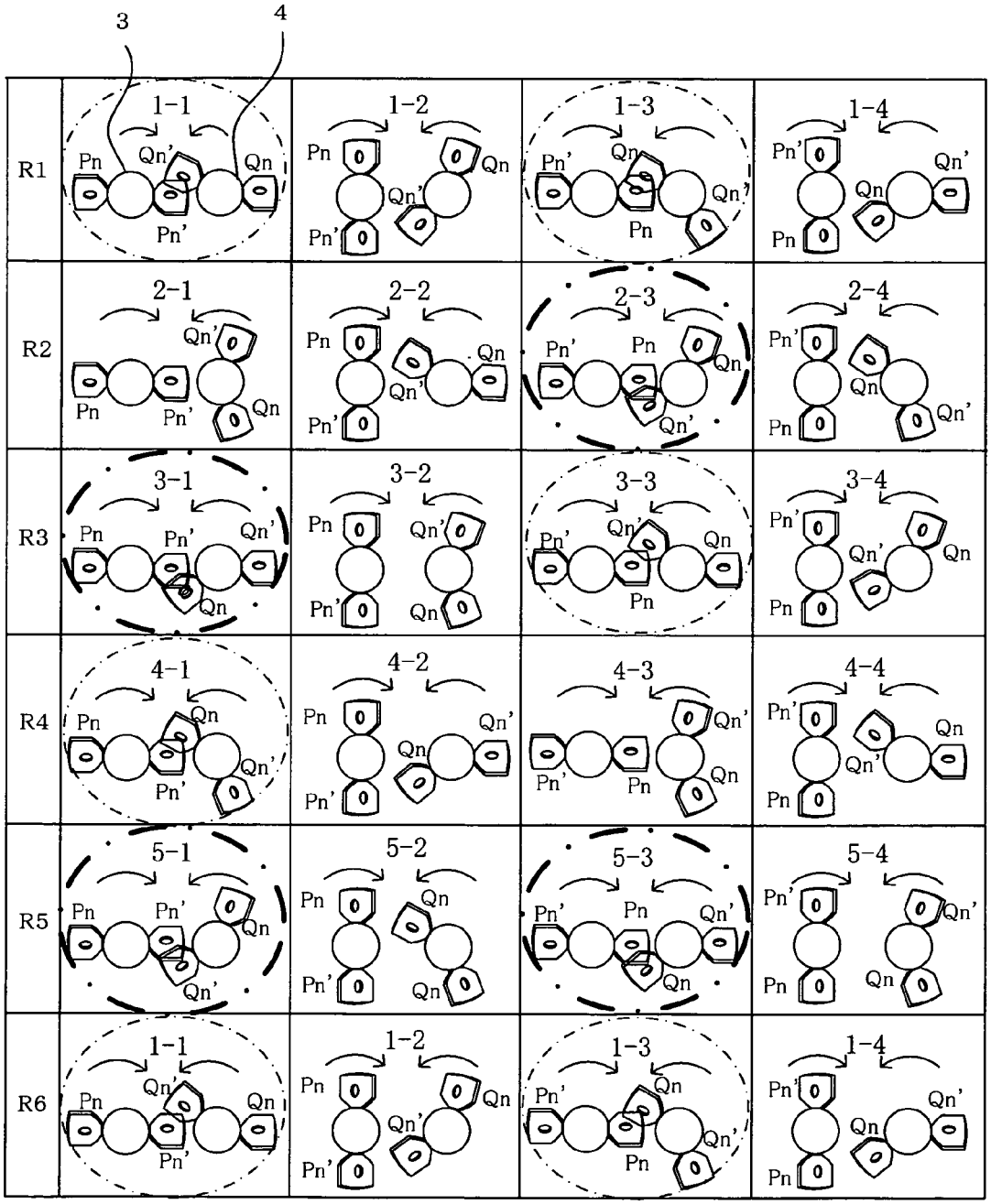
FIG. 8 is an illustrative view showing paddle positions that vary in accordance with the rotation of the rotary shafts in Embodiment 2.

The effects of kneading by the paddles of the two helices are shown in FIG. 8. FIG. 8 shows the positional arrangement of the paddles Pn, Pn' and Qn, Qn' in the same axial positions every time the rotary shaft 3 rotates once. At the kth rotation (k=1 to 6), the rotary shaft 3 rotates in 90°increments, as shown as (k-1) to (k-4). The rotational speed ratio of the rotary shafts 3 and 4 is 5:4, so the rotary shaft 4 completes four-fifths of a rotation while the rotary shaft 3 rotates once, and when the rotary shaft 3 rotates six times, the paddles are in the same position as the first rotation. In FIG. 8, Rn (n=1 to 6) indicates the nth rotation.

The rotary shaft 4 is one-fifth of a rotation behind while the rotary shaft 3 completes a full rotation, and the two shafts are different in speed. The paddles arranged on one rotary shaft therefore clean the paddles arranged on the other rotary shaft. This state in which the paddles clean each other is shown by single-dotted line ellipses in FIG. 8, and this occurs eight times during five rotations of the rotary shaft 3. The positions shown by faint single-dotted lines indicate that the faster paddles Pn (Pn') are surpassing the slower paddles Qn (Qn'), while the positions shown by bold single-dotted lines indicate that the faster paddles Pn (Pn') are catching up to the slower paddles Qn (Qn').

Figure 9:
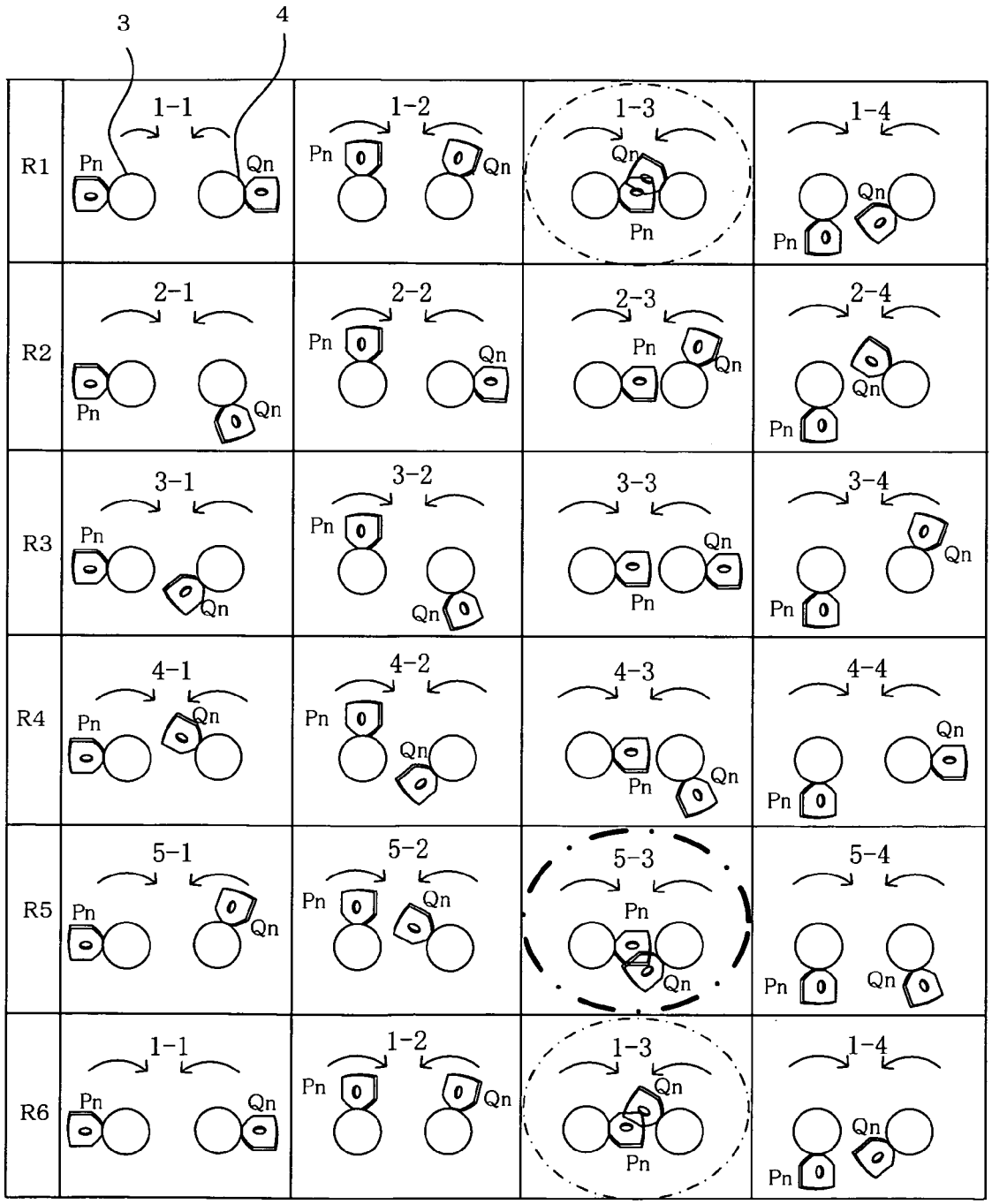
FIG. 9 is an illustrative view showing the paddle positions that vary in accordance with the rotation of the rotary shafts in Embodiment 1.

FIG. 9 is a view similar to FIG. 8 in the kneading apparatus of Embodiment 1. Since the paddles Pn, Qn are arranged in a single helix on the rotary shafts 3, 4, the number of times the paddles clean each other is limited to two during five rotations of the rotary shaft 3 as shown by the single-dotted line ellipse, and it will be understood that the cleaning effects, the lump-crushing effects, and the stirring effects of a double helix are superior as shown in Embodiment 2.

It is also understood that the double helix is superior in terms of the rotary shaft self-cleaning action in which the distal ends of the paddles come in proximity to the external periphery of the facing rotary shaft in accordance with the rotation of the rotary shafts and the distal ends scrape off the kneaded object that has adhered to the rotary shafts.

In the embodiments described above, the paddles are arranged in two helices on the rotary shafts, but the paddles may also be provided so as to be arranged along three or more helices. In this case, the helices have the same helical pitch and the same helical direction, and paddles of the helices the same distance in the axial direction have the same phase, while the paddles have phases made different by predetermined angles in the rotational direction of the rotary shafts.

Embodiment 3

Figure 10:
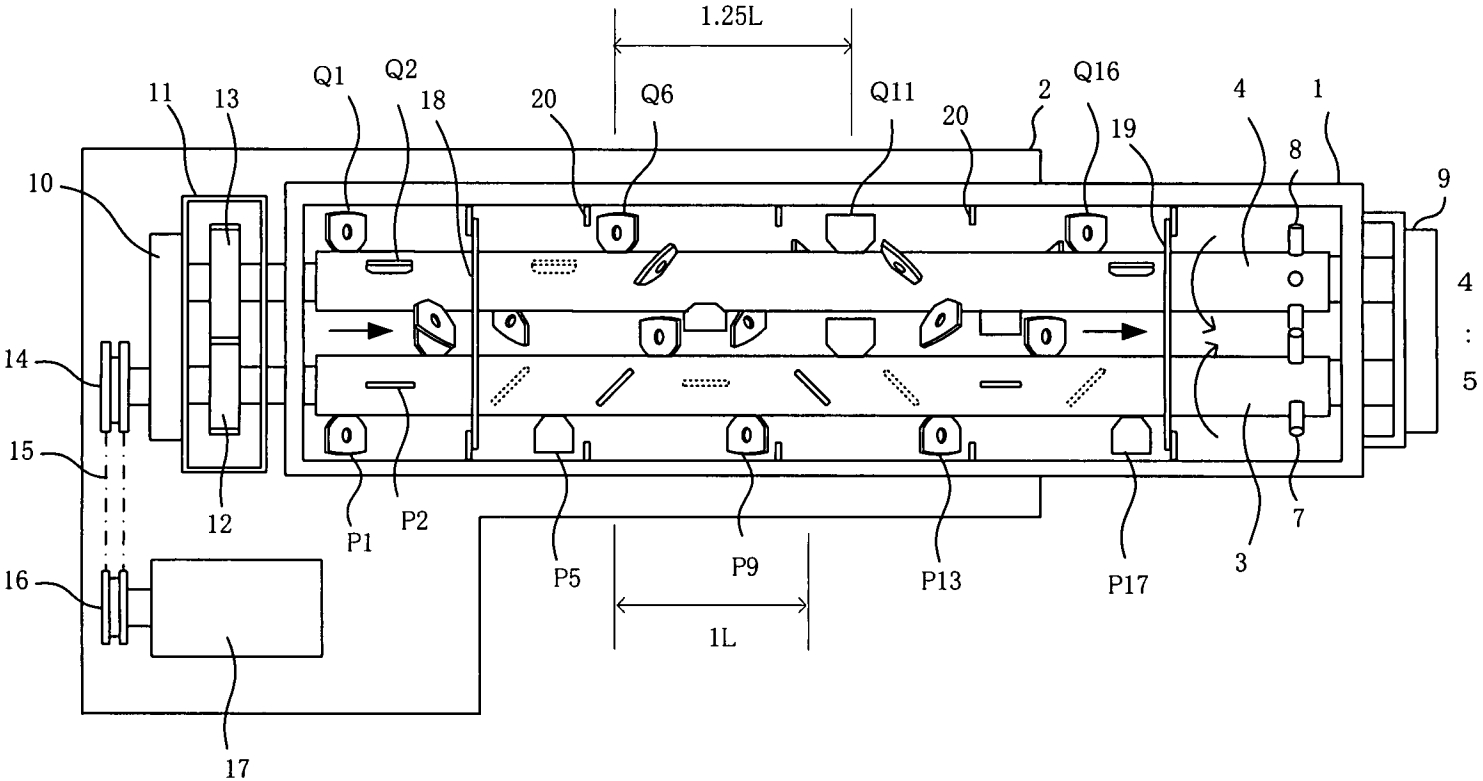
FIG. 10 is a top view showing another embodiment of a kneading apparatus in which paddles are arranged in a single helix.
Figure 11:
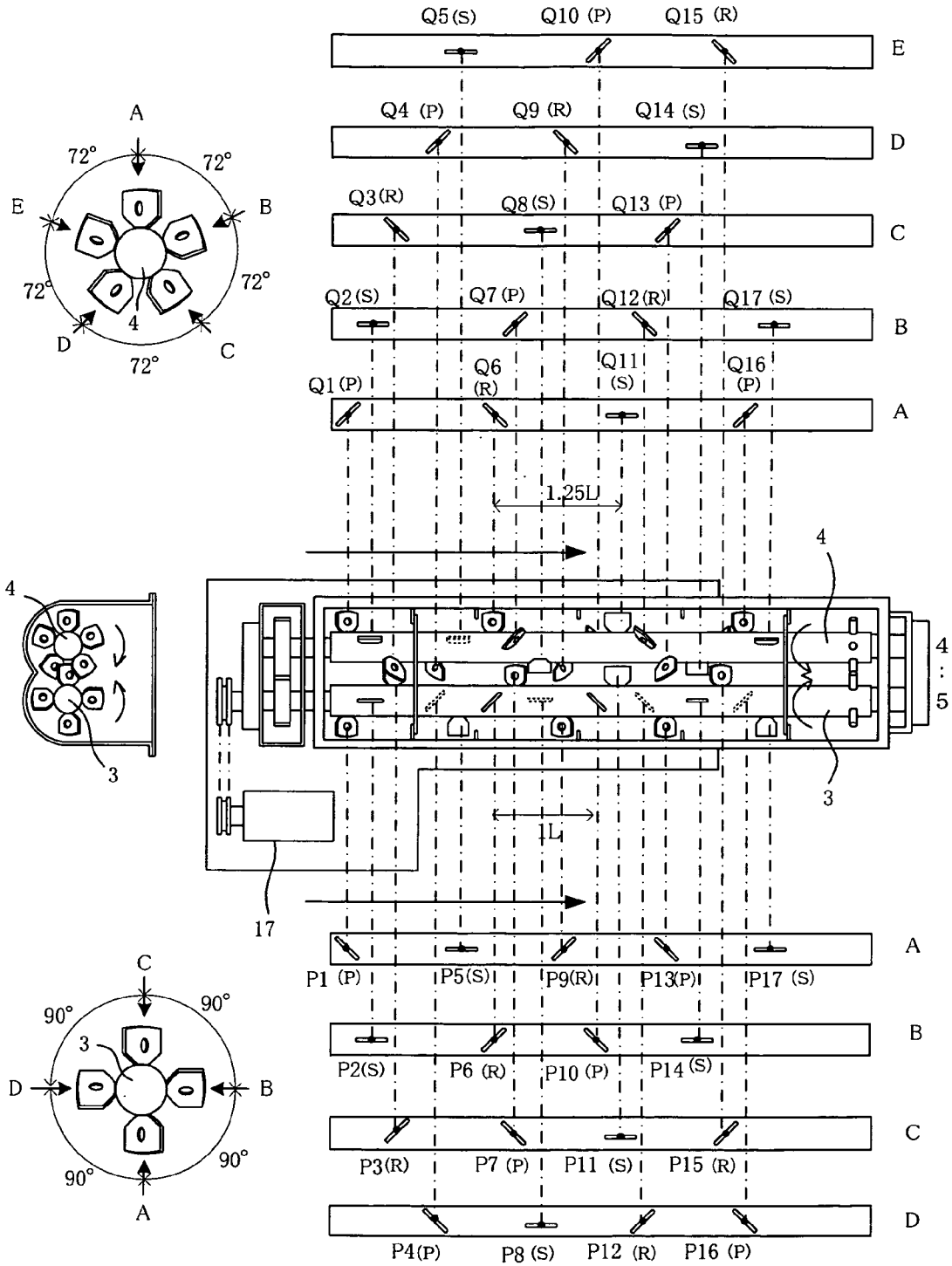
FIG. 11 is an illustrative expanded view showing the paddle arrangements on the rotary shafts in Embodiment 3.

FIGS. 10 and 11 show an embodiment in which flat phase paddles are provided having paddle surfaces oriented along the axial direction of the rotary shafts 3, 4, and the cyclically repeating sequence as viewed in the axial direction is normal, flat, and reverse. In FIG. 11, (S) indicates a flat phase paddle.

The normal phase paddles P2, P5, P8, P11, P14, P17 on the rotary shaft 3 and the normal phase paddles Q2, Q5, Q8, Q11, Q14, Q17 on the rotary shaft 4 in Embodiment 1 are made to have flat phases. In this embodiment, the kneaded object conveying force is reduced because the kneaded object fed by the normal phase paddles passes by the next flat phase paddles and is pushed back by the next reverse phase paddles. The stirring time increases in proportion to the reduction in conveying force, and the kneading degree is significantly improved. To increase the conveying force, the normal phase paddles are attached so that the paddle surfaces align along the helix, the reverse phase paddles are attached in a direction of reducing the return force, and the flat phase paddles are attached so as to be slightly oriented towards being in line with the normal phase paddle surfaces.

In Embodiment 3, the flat phase paddles can be removed so that the cyclically repeating sequence as viewed in the axial direction is normal, reverse.

The cyclically repeating sequence as viewed in the axial direction can also be normal, flat, flat; or normal, reverse, reverse.

All of the paddles of the first and second rotary shafts can also be made to have a reverse phase.

In the embodiments of Embodiment 3, the paddles can have a double helical arrangement as shown in Embodiment 2, or even an arrangement of a greater number of helices.

In the embodiments described above, the rotary shafts 3, 4 were made to rotate in mutually opposite directions of rotating inward as seen from above, but can also be made to rotate in mutually opposite directions of rotating outward. In this case, since the conveying direction is reversed, the normal phase paddles and the reverse phase paddles of the rotary shafts are exchanged, and the paddles are attached so as to form reverse helices to make the conveying direction to the same.

In all the embodiments, the paddles may not be in a cyclical arrangement, but in an unusual arrangement in the area provided with the discharge opening 1b of the kneading apparatus and/or the feed pipe (nozzle) 21 for pouring in a liquid (chemical solution). For example, in Embodiment 1, in cases in which, assuming the cyclical arrangement of "normal, normal, reverse", the phase is not normal (or reverse) in the area provided with the discharge opening 1b and the feed pipe 21, the cyclical arrangement can be disrupted to make the phase normal (or reverse).

What is claimed is:

1. A kneading apparatus comprising:

a first rotary shaft having a plurality of first stirring members provided on an external periphery thereof so as to be arranged helically at a predetermined helical pitch and at predetermined angular pitch intervals; and a second rotary shaft having a plurality of second stirring members provided on an external periphery thereof so as to be arranged helically with an inverse helix from that of the first stirring members at a predetermined helical pitch and at predetermined angular pitch intervals, the first and second rotary shafts being mounted parallel to one another to undergo rotation in opposite directions at unequal speeds to one another for kneading an object with the first and second stirring members;

wherein a helical pitch ratio of the first and second stirring members is the inverse of a rotational speed ratio of the first and second rotary shafts, and an angular pitch ratio of the first and second stirring members is the same as the rotational speed ratio of the first and second rotary shafts;

wherein the first and second stirring members are arranged so that the surfaces of the first and second stirring members assume either a normal phase to advance the kneaded object in a feed direction, or a reverse phase symmetrical to the normal phase relative to a center axis of each of the first and second shafts rotary shafts, and the first and second stirring members that are positioned equidistant from the ends thereof as viewed in the axial direction of the first and second rotary shafts face to each other with the surfaces thereof assuming the same phase;

wherein the first and second stirring members are arranged so that the normal phases and reverse phases cyclically repeat in a predetermined sequence as seen in the axial direction of the first and second rotary shafts, the predetermined sequence being normal, normal, reverse; and wherein when the first and second rotary shafts rotate in opposite directions at unequal speeds, the kneaded object is advanced in a feed direction by surfaces of the first and second stirring members facing each other and assuming the normal phase, and the kneaded object is pushed back in a direction opposite to the feed direction by surfaces of the first and second stirring members facing each other and assuming the reverse phase.

2. A kneading apparatus according to claim 1, wherein each of the first and second stirring members comprises a paddle.

3. A kneading apparatus according to claim 1, wherein the first and second rotary shafts are arranged so that distal ends of the first and second stirring members come in proximity to an external periphery of the corresponding facing first and second rotary shafts in accordance with the rotation of the first and second rotary shafts.

4. A kneading apparatus according to claim 3, wherein each of the first and second stirring members comprises a paddle.

5. A kneading apparatus according to claim 1; wherein the first and second stirring members are attached to the respective first and second rotary shafts so that the angles of the surfaces of the first and second stirring members relative to the direction in which the helix extends can be adjusted.

6. A kneading apparatus according to claim 5, wherein each of the first and second stirring members comprises a paddle.

7. A kneading apparatus according to claim 1, wherein stirring members assuming the same phase as the stirring members that are located the same distance away from the end of the first rotary shaft as viewed in the axial direction are provided respectively at locations that are the same distance away therefrom and that are different in the rotating direction of the rotary shaft by an angle that is a predetermined factor times the angular pitch of the stirring members, and stirring members assuming the same phase as the stirring members that are located the same distance away from the end of the second rotary shaft a viewed in the axial direction are provided respectively at locations that are the same distance away therefrom and that are different in the rotating direction of the rotary shaft by an angle that is a predetermined factor times the angular pitch of the stirring members.

8. A kneading apparatus according to claim 7, wherein each of the first and second stirring members comprises a paddle.

9. A kneading apparatus comprising:

a first rotary shaft having a plurality of first stirring members provided on an external periphery thereof so as to be arranged helically at a predetermined helical pitch and at predetermined angular pitch intervals; and a second rotary shaft having a plurality of second stirring members provided on an external periphery thereof so as to be arranged helically with an inverse helix from that of the first stirring members at a predetermined helical pitch and at predetermined angular pitch intervals, the first and second rotary shafts being mounted parallel to one another to undergo rotation in opposite directions at unequal speeds to one another for kneading an object with the first and second stirring members;

wherein a helical pitch ratio of the first and second stirring members is the inverse of a rotational speed ratio of the first and second rotary shafts, and an angular pitch ratio of the first and second stirring members is the same as the rotational speed ratio of the first and second rotary shafts;

wherein the first and second stirring members are arranged so that the surfaces of the first and second stirring members assume a normal phase to advance the kneaded object in a feed direction, a reverse phase symmetrical to the normal phase relative to a center axis of each of the first and second shafts rotary shafts, or a flat phase oriented along the axial direction of the first and second rotary shafts, and the first and second stirring members that are positioned equidistant from the ends thereof as viewed in the axial direction of the first and second rotary shafts face to each other with the surfaces thereof assuming the same phase;

wherein the first and second stirring members are arranged so that the normal phases, flat phases and reverse phases cyclically repeat in a predetermined sequence as seen in the axial direction of the first and second rotary shafts, the predetermined sequence being normal, flat, reverse; and wherein when the first and second rotary shafts rotate in opposite directions at unequal speeds, the kneaded object is advanced in a feed direction by surfaces of the first and second stirring members facing each other and assuming the normal phase, passes through the first and second stirring members facing each other assuming the flat phase, and is pushed back in a direction opposite to the feed direction by surfaces of the first and second stirring members facing each other and assuming the reverse phase.

10. A kneading apparatus according to claim 9, wherein each of the first and second stirring members comprises a paddle.

11. A kneading apparatus according to claim 9, wherein the first and second rotary shafts are arranged so that distal ends of the first and second stirring members come in proximity to an external periphery of the corresponding facing first and second rotary shafts in accordance with the rotation of the first and second rotary shafts.

12. A kneading apparatus according to claim 11, wherein each of the first and second stirring members comprises a paddle.

13. A kneading apparatus according to claim 9; wherein the first and second stirring members are attached to the respective first and second rotary shafts so that the angles of the surfaces of the first and second stirring members relative to the direction in which the helix extends can be adjusted.

14. A kneading apparatus according to claim 13, wherein each of the first and second stirring members comprises a paddle.

15. A kneading apparatus according to claim 9, wherein stirring members assuming the same phase as the stirring members that are located the same distance away from the end of the first rotary shaft as viewed in the axial direction are provided respectively at locations that are the same distance away therefrom and that are different in the rotating direction of the rotary shaft by an angle that is a predetermined factor times the angular pitch of the stirring members, and stirring members assuming the same phase as the stirring members that are located the same distance away from the end of the second rotary shaft a viewed in the axial direction are provided respectively at locations that are the same distance away therefrom and that are different in the rotating direction of the rotary shaft by an angle that is a predetermined factor times the angular pitch of the stirring members.

16. A kneading apparatus according to claim 15, wherein each of the first and second stirring members comprises a paddle.

* * * * *